US011139600B1

(12) United States Patent
Kinsey, Jr. et al.

(10) Patent No.: US 11,139,600 B1
(45) Date of Patent: Oct. 5, 2021

(54) HIGH PERFORMANCE CONTACT ELEMENT

(71) Applicant: TE Connectivity Services GmbH, Schaffhausen (CH)

(72) Inventors: Forrest Irving Kinsey, Jr., Harrisburg, PA (US); John Mark Myer, Millersville, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/908,955

(22) Filed: Jun. 23, 2020

(51) Int. Cl.
*H01R 13/187* (2006.01)
*H01R 13/11* (2006.01)

(52) U.S. Cl.
CPC ..... *H01R 13/111* (2013.01); *H01R 2201/26* (2013.01)

(58) Field of Classification Search
CPC ..... H01R 13/111; H01R 13/187
USPC ..... 439/843
See application file for complete search history.

(56) References Cited

U.S. PATENT DOCUMENTS 4,120,557 A * 10/1978 Horrocks ..... H01R 13/15 439/827
4,128,293 A * 12/1978 Paoli ..... H01R 13/187 439/843
5,667,413 A * 9/1997 Trafton ..... H01R 13/187 439/271
6,062,919 A * 5/2000 Trafton ..... H01R 13/187 439/843
6,752,668 B2 * 6/2004 Koch, Jr. ..... H01R 13/187 439/387
6,899,571 B1 * 5/2005 Koch ..... H01R 4/4881 439/843
8,057,269 B2 * 11/2011 Ledermann ..... H01R 13/187 439/827
9,608,341 B2 * 3/2017 Saur ..... H01R 13/187
10,347,996 B2 * 7/2019 Kung ..... C25D 5/12
10,535,943 B2 * 1/2020 Szymura ..... H01R 13/111
10,879,656 B2 * 12/2020 Wang ..... H01R 13/42
10,923,846 B1 * 2/2021 Raybold ..... H01R 13/187

* cited by examiner

*Primary Examiner* — Neil Abrams

(57) ABSTRACT

A contact element for providing high current capabilities between an electrical contact and a mating contact. The contact element has multiple first resilient contact arms and multiple second resilient contact arms. The first resilient contact arms extend from a first contact strip to a second contact strip. The second resilient contact arms extend from the second contact strip and are formed to extend toward the first contact strip. The second resilient contact arms are offset from the first resilient contact arms, wherein free ends of the second resilient contact arms positioned proximate the first contact strip. The first resilient contact arms and the second resilient contact arms provide contact sections which allow for the passage of a high amperage current with low resistance and low temperature.

20 Claims, 6 Drawing Sheets

HIGH PERFORMANCE CONTACT ELEMENT

FIELD OF THE INVENTION

The present invention is directed to a spring contact element which provides high current capabilities while providing a reliable connection to the mating contact.

BACKGROUND OF THE INVENTION

Electrical connectors for military, aviation, vehicular and other applications which require power must be able to withstand the environmental conditions, such as high vibrations, to which such connectors are subjected. The connectors also must provide high quality electrical connection through very broad ranges of temperature variations and harsh conditions. In many instances these electrical connectors must also accommodate extremely high amperage.

Examples of such electrical connectors which are found in the prior art may include a threaded stud terminal to which a threaded nut may be selectively connected. A typical prior art terminal for connection to such threaded stud terminal includes a mating end effectively defining a generally planar eyelet that is dimensioned to be slidably passed over the threaded stud terminal. The opposed end of such a terminal typically will be crimped and/or soldered to a conductor of the wire. The eyelet is maintained in a mated condition on the threaded stud terminal by the nut which is threaded tightly against the planar portion of the eyelet for securely retaining the terminal on the threaded stud terminal and for providing the high contact forces that are desired.

Such typical prior art electrical connector performs well under routine environmental conditions. However, the threaded components of these prior art connectors are fairly expensive to manufacture. Furthermore, the threaded interconnection adds significantly to assembly time and costs and can make disassembly for periodic repair and maintenance difficult, particularly as torque wrenches are required to properly seat the hardware. A number of parts are required to perfect the electrical connection, thereby also adding to the cost of the connection and creating the possibility of foreign object debris (FOD) which could damage engines and the like. Also, as the connectors are exposed to vibration and the like, the nuts may rotate off of the threaded component, which can lead to a failed, open electrical connection. In addition, any attempt to provide environmental sealing for such an electrical connection will generally require an entirely separate protection means that is functionally and structurally unrelated to the threaded interconnection to the alternator.

Various prior art electrical connectors rely upon resiliency of the metal to achieve electrical connection. However, it is extremely difficult to achieve the high contact forces with an electrical connector that must also ensure a large surface contact area and a large cross sectional area of metal to affect a reliable electrical connection.

Other examples of prior art electrical connectors have included springs means which are intended to achieve secure electrical connection without resorting to combinations of threads and nuts. It has proven to be disadvantageous with these known contact spring sockets that one must have a relatively large sleeve to mount the contact springs and hold them in place, particularly in the case where one attempts miniaturization of contact spring sockets. In addition, the manufacture of such springs contacts can prove difficult, particularly in application in which the space is limited, as the punch tooling required to manufacture the springs may have sufficient clearance, thereby limiting the closeness of the spacing of the spring arms of the spring contacts.

It would, therefore, be beneficial to provide a spring contact element which has closely spaced contact arms to provide for more contact points to accommodate high current carrying capacity while requiring low insertion forces. In addition, it would be beneficial to provide a spring contact element which has multiple contact points provided in line with each other to facilitate a cleaning action to allow for a positive electrical connection in harsh environment.

SUMMARY OF THE INVENTION

It is another object of the subject invention to provide contact elements which are reliable and have high current capabilities.

It is another object of the subject invention to have a high amperage contact element which can be used over many cycles and which enables quick connection and disconnection.

It is another object of the subject invention to provide a system in which increased contact points are provided between a contact element and the mating post.

An embodiment is directed to a contact element for providing high current capabilities between an electrical contact and a mating contact. The contact element has multiple first resilient contact arms and multiple second resilient contact arms. The first resilient contact arms extend from a first contact strip to a second contact strip. The first resilient contact arms have first contact sections and second contact sections. The first contact sections of the first resilient contact arms electrically engage the mating contact and the second contact sections of the first resilient contact arms electrically engage a portion of the electrical contact when the mating contact is fully inserted into the electrical contact. The second resilient contact arms extend from the second contact strip and are formed to extend toward the first contact strip. The second resilient contact arms are offset from the first resilient contact arms, wherein free ends of the second resilient contact arms positioned proximate the first contact strip. The second contact arms have first contact sections and second resilient contact sections. The first contact sections of the second resilient contact arms electrically engage the mating contact and the second contact sections of the second resilient contact arms electrically engage a portion of the electrical contact when the mating contact is fully inserted into the electrical contact. The first contact sections of the first resilient contact arms, the second contact sections of the first resilient contact arms, the first contact sections of the second resilient contact arms, and the second contact sections of the second resilient contact arms provide contact sections which allow for the passage of a high amperage current with low resistance and low temperature.

An embodiment is directed to a contact element for providing high current capabilities between an electrical contact and a mating contact The contact element has multiple first resilient contact arms, multiple second resilient contact arms and multiple third resilient contact arms. The contact element has multiple first resilient contact arms and multiple second resilient contact arms. The first resilient contact arms extend from a first contact strip to a second contact strip. The first resilient contact arms have first contact sections and second contact sections. The first contact sections of the first resilient contact arms electrically engage the mating contact and the second contact sections of the first resilient contact arms electrically engage a portion of the electrical contact when the mating contact is fully inserted into the electrical contact. The second resilient contact arms extend from the second contact strip and are formed to extend toward the first contact strip. The second resilient contact arms are offset from the first resilient contact arms, wherein free ends of the second resilient contact arms positioned proximate the first contact strip. The second contact arms have first contact sections and second resilient contact sections. The first contact sections of the second resilient contact arms electrically engage the mating contact and the second contact sections of the second resilient contact arms electrically engage a portion of the electrical contact when the mating contact is fully inserted into the electrical contact. The third resilient contact arms extend from the second contact strip. The third resilient contact arms positioned in line with the first resilient contact arms and offset from the second resilient contact arms. The third resilient contact arms are formed wherein free ends of the third resilient contact arms are positioned proximate the second contact strip. The third contact arms have first contact sections, the first contact sections of the third resilient contact arms electrically engage the mating contact when the mating contact is fully inserted into the electrical contact.

An embodiment is directed to an electrical contact for mating with a mating contact. The electrical contact includes a passage for receiving a mating contact. The passage has a recess with a contact surface. A contact element is positioned in the recess. The contact element includes multiple first resilient contact arms which extend from a first contact strip to a second contact strip. The first resilient contact arms have first contact sections and second contact sections. The first contact sections of the first resilient contact arms electrically engage the mating contact and the second contact sections of the first resilient contact arms electrically engage the contact surface when the mating contact is fully inserted into the electrical contact. The contact element also includes multiple second resilient contact arms which extend from the second contact strip and which are formed to extend toward the first contact strip. The second resilient contact arms are offset from the first resilient contact arms. Free ends of the second resilient contact arms are positioned proximate the first contact strip. The second contact arms have first contact sections and second resilient contact sections. The first contact sections of the second resilient contact arms electrically engage the mating contact and the second contact sections of the second resilient contact arms electrically engage the contact surface when the mating contact is fully inserted into the electrical contact. The recess has retaining shoulders to retain the contact element in the recess.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
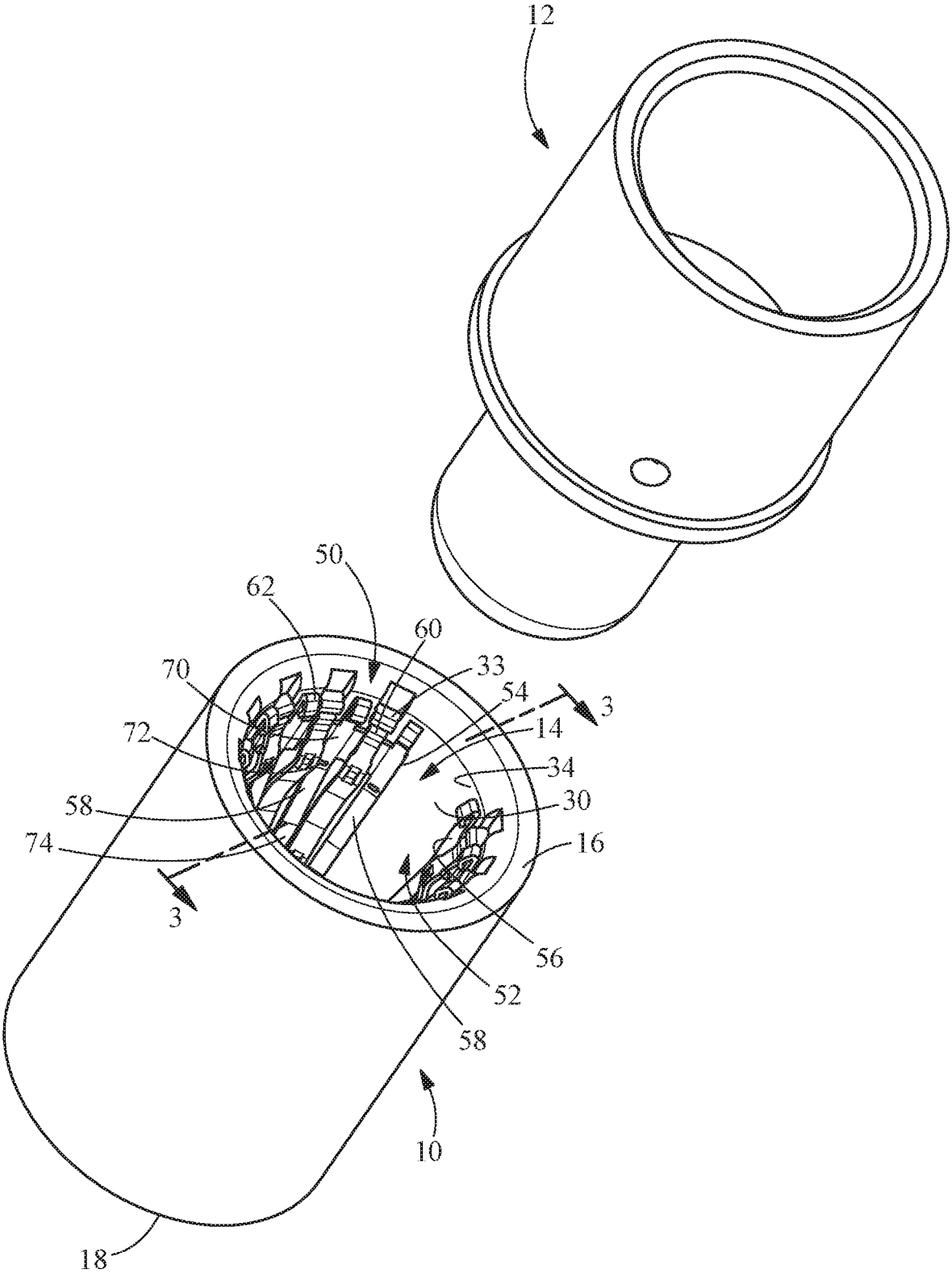
FIG. 1 is a perspective view of an illustrative male contact prior to insertion into a receiving cavity of an illustrative female contact, the female contact having contact elements of the present invention inserted therein.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

The present invention is directed to a contact element which provides a quick and simple connection to a mating contact. In particular, the invention is directed to a contact element which provides high current capabilities while providing a reliable connection to the mating contact. While the contact element 50 is shown positioned in an exemplary electrical contact 10, the contact element 50 may be used with many different types of contacts or contact assemblies. The use of the contact element 50 is, therefore, not limited to use with the illustrative electrical contact and/or the mating contact disclosed herein.

Figure 2:
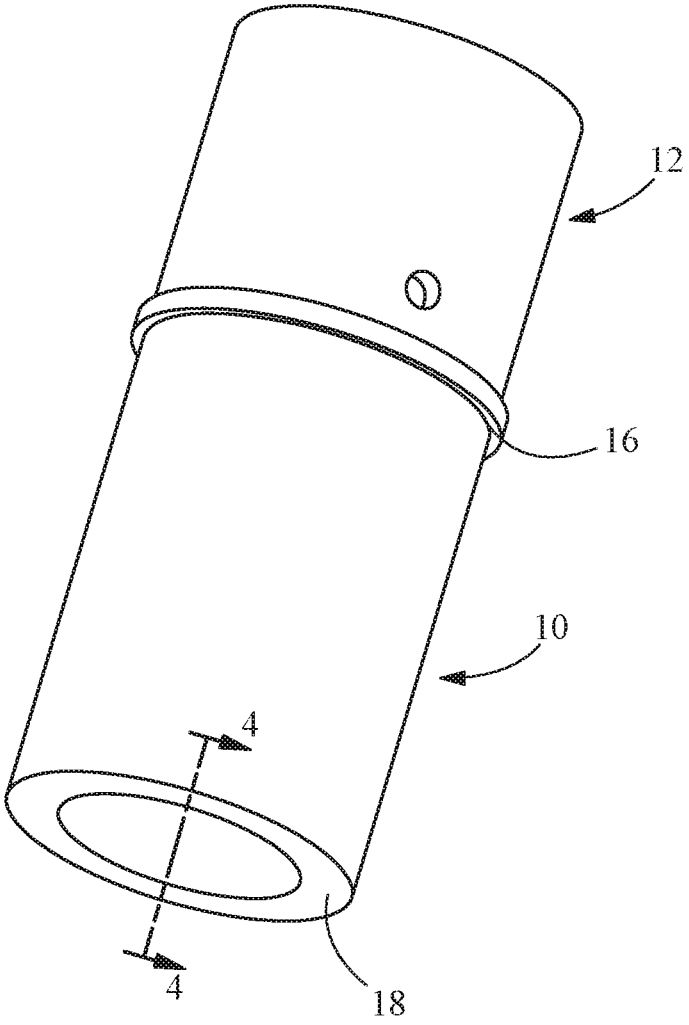
FIG. 2 is a perspective view of the illustrative male contact of FIG. 1 inserted into the receiving cavity of the female contact.
Figure 4:
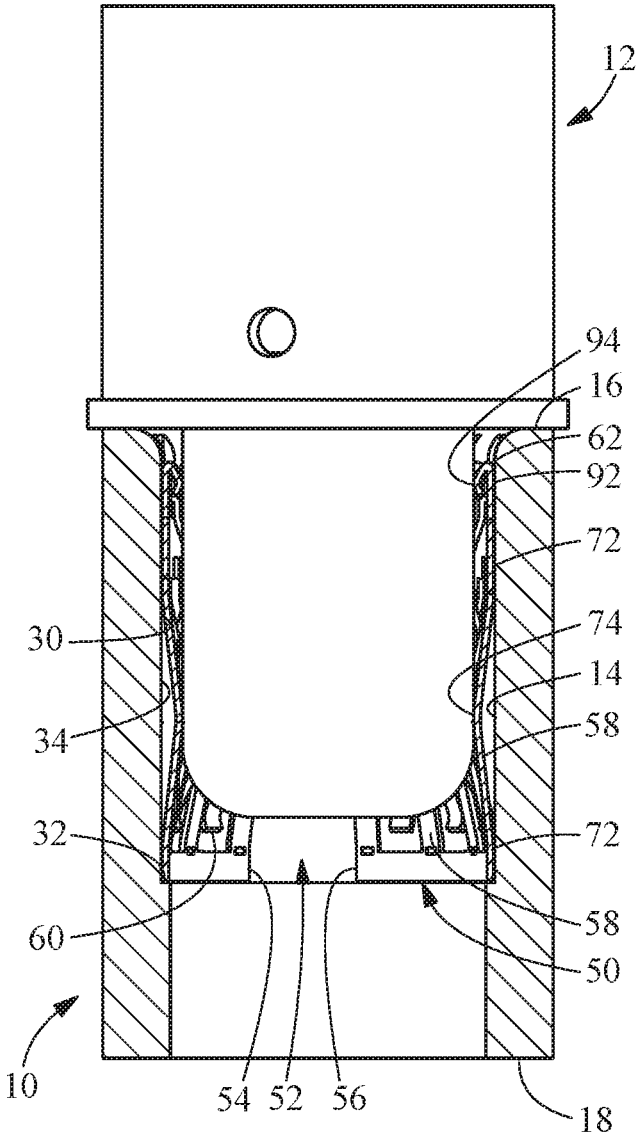
FIG. 4 is a partial cross-sectional view taken along line 4-4 of FIG. 2 illustrating the contact elements positioned in the receiving cavity of the female contact prior with the male contact inserted into the receiving cavity.

FIG. 1 illustrates a perspective view of an illustrative electrical contact or receptacle 10 into which a contact element 50 may be inserted. The contact 10 is shown prior to mating with a mating contact 12, such as, but not limited to, a post or mating pin 12. FIGS. 2 and 4 illustrate the contact 10 and the mating contact 12 in a fully mated position. The electrical contact 10 and the mating contact 12 are shown as illustrative representations, as the particular configuration of the contact 10 and mating contact 12 may vary without departing from the scope of the invention. Therefore, the use and applicability of the contact element 50 is not limited to the illustrative contact 10 shown.

The mating contact 12 has a predetermined diameter D1 and a predetermined length. The diameter of the mating contact 12 is proportioned so that the rated current and voltage can be safely transmitted. The length is selected so that the mating contact 12 will be fully received within the contact 10 without exposing electrically conducting portions of the mating contact 12 to casual contact during use and/or maintenance. The end portion of the mating contact 12 typically is rounded. The rounded end facilitates mating of the mating contact 12 to the contact 10. However, other configurations of the post may be provided without departing from the scope of the invention.

As shown in FIGS. 1 through 4, the illustrative electrical contact 10 has a post receiving passage 14 for receiving the respective mating contact 12 therein. In the embodiment shown, the electrical contact 10 is a high amperage power contact that is capable of carrying, for example, up to about 600 amps or more, with a relatively small footprint. The electrical contact 10 has a first end 16 and an oppositely facing second end 18 which has the post receiving passage 14 therein. A conductor or wire receiving opening (not shown) extends from the second end 18 to proximate the post receiving passage 14. A conductor or wire (not shown), is inserted into a conductive wire receiving opening and is terminated thereto by crimping or other known termination methods. An insulation receiving recess may extend circumferentially around a portion of the contact 10 to allow an insulator, such as, but not limited to, a boot, to be installed. Alternatively, the electrical contact 10 may be provided in an electrical connector which includes a housing surrounding the contact 10 to provide the required electrical insulation.

The contact 10 is made from an electrically conductive material, such as, but not limited to, phosphor-bronze, brass, beryllium-copper alloy, stainless steel, etc. The contact 10 may be provided in an electrical connector with a housing body, which is made from plastic or other material having nonconductive properties, thereby allowing the housing body and the contact 10 to be engaged by the operator/user.

A contact member receiving recess 30 extends circumferentially about the post receiving passage 14. The contact member receiving recess 30 has a larger diameter D2 (FIG. 3) than the diameter D3 (FIG. 3) of the post receiving passage 14. Retaining shoulders 32 extend circumferentially about the contact member receiving recesses 30. The retaining shoulders 32 define the transition of the recesses 30 from the post receiving passage 14. An outer surface 34 extends circumferentially about the receiving recess 30 between the retaining shoulders 32. In various illustrative embodiments, a portion of the recess 30 proximate the first end 16 may be skived or deformed to create a locking shoulder 33.

Figure 3:
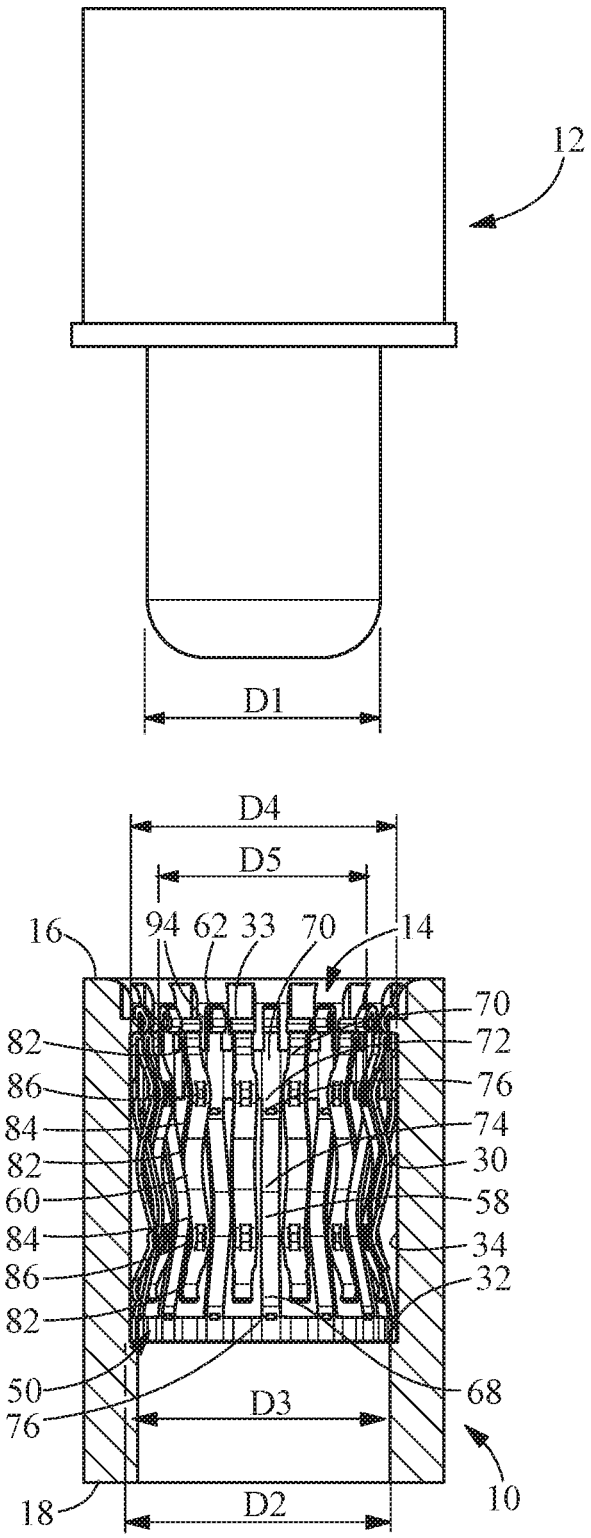
FIG. 3 is a partial cross-sectional view taken along line 3-3 of FIG. 1 illustrating the contact elements positioned in the receiving cavity of the female contact prior to the male contact being inserted into the receiving cavity.
Figure 6:
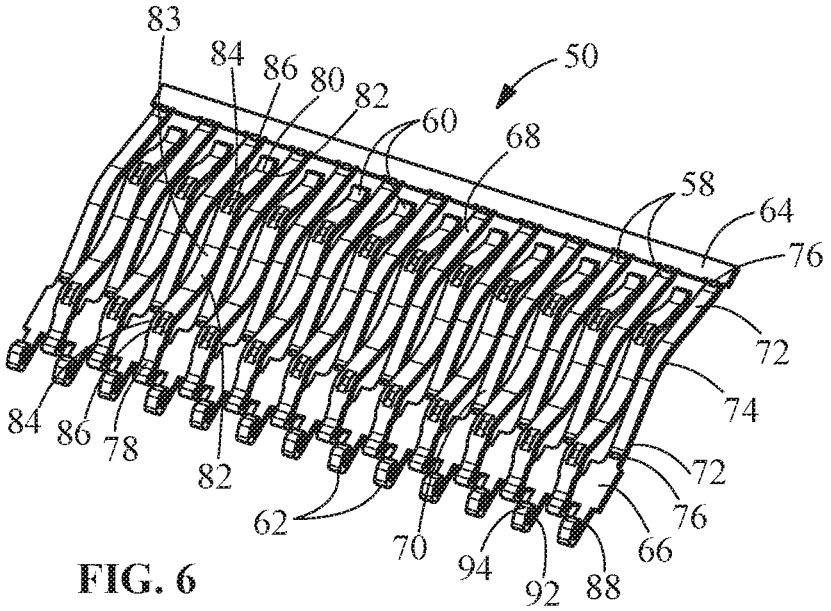
FIG. 6 is a perspective view of the contact element of FIG. 5 prior to forming the contact element into a cylindrical shape.
Figure 7:
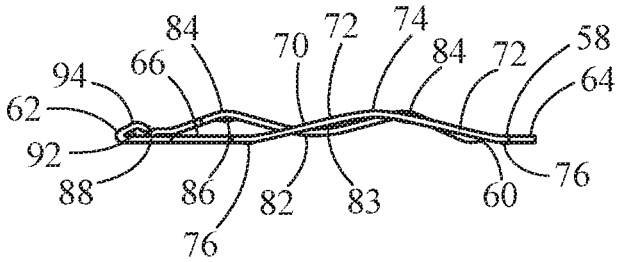
FIG. 7 is a side view of the contact element of FIG. 6.

A contact member or element 50 is positioned in the contact member receiving recesses 30. As shown in FIG. 3, retaining shoulders 32 cooperate with the contact element 50 to retain the contact element 50 in the respective contact member receiving recesses 30. The element 50 may be manufactured in a continuous strip, cut to length (FIG. 8), and bent into the desired shape (FIGS. 6 and 7). Alternatively, the elements may be manufactured as individual pieces in the desired shape, such as, but not limited to, circular. The contact element 50 may be manufactured by different methods, including, but not limited to, stamping and forming or extrusion.

In the illustrative embodiment shown, the contact element 50 are configured to be positioned in the recess 30 of the contact 10. However, the contact element 50 may be used in any application which required a compact, reliable contact element which is required to have high current capabilities and which can be used over many cycles. Therefore, depending upon the application, the contact element may be joined by a carrier strip on the like in many different configurations, including, but not limited to, in a linear strip, in a circular configuration or in an oval configuration.

In the illustrative embodiment shown, in which the contact element 50 is positioned in a generally cylindrical recess 30, the outside diameter D4 (FIG. 3) of the contact element 50 is larger than the diameter D3 of the passage 14, whereby as the contact element 50 is inserted into the recess 30, the contact element 50 will be retained in the receiving recess 30 without the need for additional mounting hardware. The inside diameter D5 (FIG. 3) of the contact element 50 is dimensioned such that the lateral clearance of the inside diameter D5 is less than the diameter D1 of the post 12. The outside diameter D4 of the contact element 50 may be slightly smaller, essentially equal, or slightly larger than the diameter D2 of the recess 30.

Figure 5:
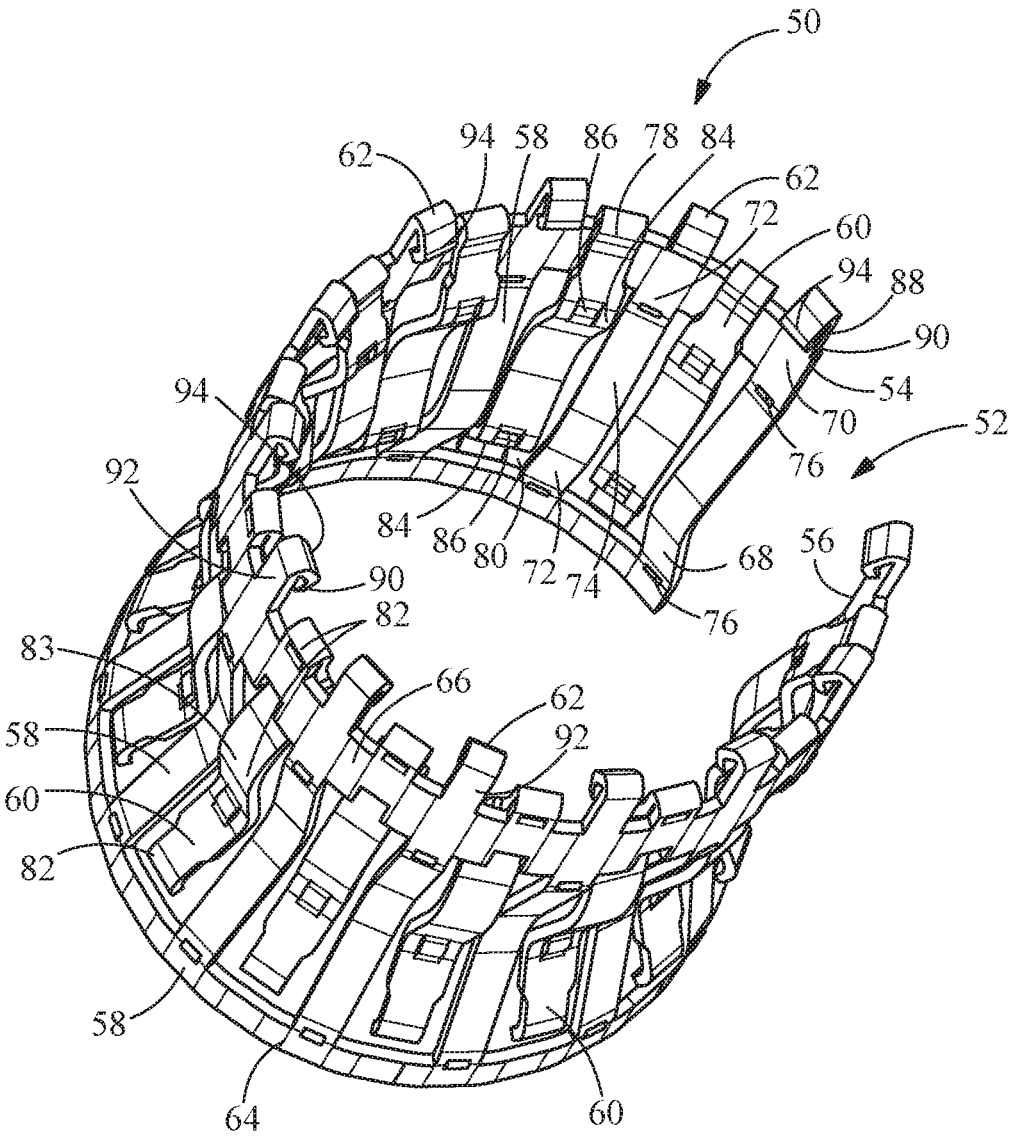
FIG. 5 is a perspective view of the illustrative contact element shown in FIG. 1.

As shown in FIGS. 1 and 5, the contact element 50 is formed with a gap 52 provided between a first end 54 and a second end 56 of the contact element 50. This gap 52 allows the contact element 50 to be resiliently compressed to allow the contact element 50 to be inserted into the passage 14. As the contact element 50 is moved into position proximate the recess 30, the contact element 50 returns toward an unstressed position, thereby causing the contact element 50 to snap or expand in the recess 30 and be resiliently retained in the recess 30.

As shown in FIGS. 5 through 7, the illustrative contact member 50 has multiple first resilient contact arms 58, multiple second resilient contact arms 60 and multiple third resilient contact arms 62.

Each of the first resilient contact arms 58 extends from a first contact strip 64 to a second contact strip 66. First ends 68 of the first resilient contact arms 58 are integrally attached to the first contact strip 64. Second ends 70 of the first resilient contact arms 58 are integrally attached to the second contact strip 66. The first resilient contact arms 58 are formed to have a curved configuration with contact engagement portions 72 positioned proximate the first ends 68 and the second ends 70. Mating contact engagement portions 74 are provided on the first resilient contact arms 58 between the contact engagement portions 72. In the illustrative embodiment shown, the mating contact engagement portion 74 of each first resilient contact arm 58 is positioned approximately equidistant from the respective contact engagement portions 72. The contact engagement portions 72 have projections or embossments 76 which extend therefrom in a direction away from the mating contact engagement portions 74. The projections or embossments 76 cooperate with the contact 10 to facilitate the electrical and mechanical connection between the first resilient contact arms 58 of the contact member 50 and the contact 10.

Each of the second resilient contact arms 60 extends from the second contact strip 66. First ends 78 of the second resilient contact arms 60 are integrally attached to the second contact strip 66. The first ends 78 extend in a direction away from the first contact strip 64. The second resilient contact arms 60 are formed such that the second resilient contact arms 60 are bent 180 degrees proximate the first ends 78, whereby second or free ends 80 of the second resilient contact arms 60 extend toward and are positioned proximate to, but spaced from, the first contact strip 64. The second resilient contact arms 60 are formed to have an undulating configuration with contact engagement portions 82 positioned proximate center portions 83. Mating contact engagement portions 84 are provided on the second resilient contact arms 60 on either side of the contact engagement portions 82, for example proximate the first ends 78 and proximate the second ends 80. The mating contact engagement portions 84 have projections or embossments 86 which extend therefrom in a direction away from the contact engagement portions 82. The projections or embossments 86 cooperate with the mating contact 12 to facilitate the electrical and mechanical connection between the second resilient contact arms 60 of the contact member 50 and the mating contact 12.

Each of the third resilient contact arms 62 extends from the second contact strip 66 in a direction away from the first contact strip 64. First ends 88 of the third resilient contact arms 62 are integrally attached to the second contact strip 66. The third resilient contact arms 62 are formed such that the third resilient contact arms 62 are bent 180 degrees proximate the first ends 88, thereby positioning second or free ends 90 of the third resilient contact arms 62 proximate to, but spaced from, the second contact strip 66. Contact engagement portions 92 are provided on the third resilient contact arms 62 proximate the first ends 88. Mating contact engagement portions 94 are provided on the third resilient contact arms 62 proximate the second ends 90.

The contact elements 50 are manufactured from an electrically conductive material, such as, but not limited to, phosphor-bronze, brass, beryllium-copper alloy, stainless steel, etc. In order to enhance the electrical conductivity of the contact elements 50, the elements 50 may be plated using known techniques and materials, such techniques may include, but are not limited to immersing the contact elements 50 in a plating bath or selectively plating only the contact sections of the contact elements 50.

Figure 8:
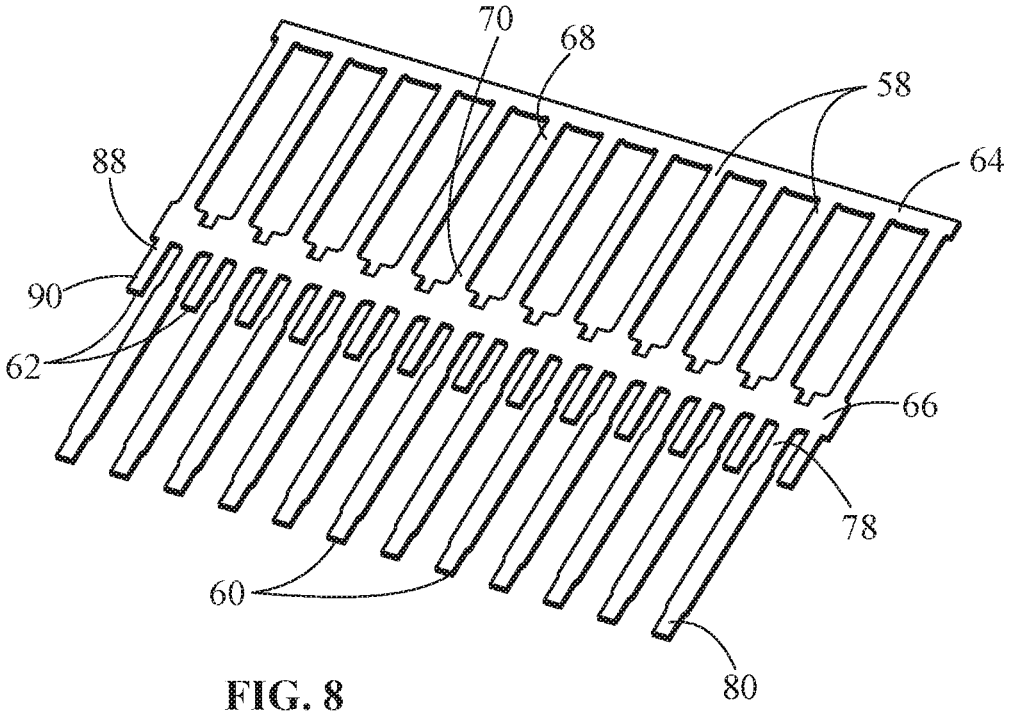
FIG. 8 is a perspective view of the stamped contact element of FIG. 5 prior to forming the contact arms.

As shown in FIG. 8, during the manufacture of the contact elements 50, the first resilient contact arms 58 are stamped from material on one side of the second contact strip 66, while the second resilient contact arms 60 are stamped from material on the other side of the second contact strip 66. Consequently, the first resilient contact arms 58 are not stamped out side-by-side to the second resilient contact arms 60. This allows the punch tooling to be more robust, as the punch tooling does not need to be thin.

As the second resilient contact arms 60 are offset from the first resilient contact arms 58, the folding of the second resilient contact arms 60 positions the second resilient contact arms 60 between the first resilient contact arms 58, thereby increasing the number of contact and mating contact engagement portions or points provided on the contact elements 50. This allows for the steady state current load and the transient (short term) current allowance to be increased. Additionally, due to the increase in the number of contact and mating contact engagement portion or points, a lower normal force is needed to properly mate the mating contact 12 to the contact 10, resulting the contact 10 and contact element 50 having a high mating cycle allowance.

As the third resilient contact arms 62 are positioned in line with the first resilient contact arms 58, the mating contact engagement portions 94 of the third resilient contact arms 62 are positioned in line with respective mating contact engagement portions 74 of the first resilient contact arms 58. Consequently, as the mating contact 12 is moved into engagement with the contact 10, mating contact engagement portions 74, 94 are provided along the longitudinal axis of each of the respective third resilient contact arms 62 and first resilient contact arms 58. This is beneficial as additional points of contact are beneficial for the reasons described above.

As the mating contact engagement portions 94 of the third resilient contact arms 62 are positioned proximate the first end 16 of the contact 10, the mating contact engagement portions 94 of the third resilient contact arms 62 engage the mating contact 12 prior to the mating contact 12 engaging the first contact arms 58 and the second contact arms 60. In addition, as mating contact engagement portions 74, 94 are provided along the longitudinal axis of each of the respective third resilient contact arms 62 and first resilient contact arms 58, the mating contact engagement portion 94 can be used to provide a wiping to cleaning action to remove oxides or debris from the mating contact 12, particularly in harsh environments, thereby ensuring that an effective electrical connection is made between the mating contact engagement portion 74 and the mating contact 12.

Similarly, the second resilient contact arms 60 have multiple mating contact engagement portions 84 are positioned in line with each other. Consequently, as the mating contact 12 is moved into engagement with the contact 10, mating contact engagement portions 84 are provided along the longitudinal axis of each of the respective second resilient contact arms 60. This is beneficial as additional points of contact are beneficial for the reasons described above.

In addition, as mating contact engagement portions 84 are provided along the longitudinal axis of each of the respective second resilient contact arms 60, the first mating contact engagement portion 84 can be used to provide a wiping to cleaning action to remove oxides or debris from the mating contact 12, particularly in harsh environments, thereby ensuring that an effective electrical connection is made between the second mating contact engagement portion 84 and the mating contact 12.

The configuration of the contact element 50 provides greater contact portion between the mating contact 12 and the contact 10 which increases the contact area between the contact element 50 and the mating contact 12 and the contact element 50 and the outer surface 34 of the recess 30 of the contact 10. The increased contact area provides high current capabilities allowing improved electrical conductivity. Improved electrical conductivity is exemplified by lower operating temperatures of the contact element, and lower resistive loss between connections resulting in lower voltage drop and lower power consumption. The configuration of the contact element 50 is proportioned so that the rated current and voltage can be safely transmitted across the contact element 50.

As previously described, the contact element 50 is retained in the recess 30 by the contact element 50 returning toward the unstressed position, thereby causing the contact element 50 to snap or expand in the recess 30 and be resiliently retained in the recess 30. In addition, in various illustrative embodiments, a portion of the recess 30 proximate the first end 16 may be skived or deformed to create a locking shoulder 33 which engages the second contact strip 66 to prevent the removal of the contact element 50 from the passage 14 through the first end 16 of the contact 10.

With contact element 50 properly positioned in receiving recess 30, the mating contact 12 is inserted into the passage 14 of contact 10. As insertion occurs, the contact arms 58, 60, 62 are resiliently deformed toward the outer surface 34 of the contact member receiving recess 30.

At the mating contact 12 is inserted into the passage 14, the mating contact 12 engages the mating contact engagement portions 94 of the third resilient contact arms 62. This causes the mating contact engagement portions 94 to resiliently deform, creating a mechanical and electrical connection between the mating contact engagement portions 94 and the mating contact 12. Continued insertion of the mating contact 12 causes the mating contact 12 to move relative to the mating contact engagement portions 94, causing a wiping action to remove any unwanted contaminants from the mating contact 12.

As insertion of the mating contact 12 continues, the mating contact 12 engages the embossments 86 of the first mating contact engagement portions 84 of the second resilient contact arms 60. This causes the first mating contact engagement portions 84 and the second resilient contact arms 60 to resiliently deform, creating a mechanical and electrical connection between the first mating contact engagement portions 84 and the mating contact 12. As the second resilient contact arms 60 are deformed, the contact engagement portions 82 of the second resilient contact arms 60 are deflected toward the outer surface 34 of the receiving recess 30 causing the contact engagement portions 82 to engage the outer surface 34 and exert a force on the outer surfaces 34, thereby placing the contact engagement portions 82 in mechanical and electrical engagement with the wall of the passage 14 of contact 10, forming an electrical pathway between the mating contact 12 and the contact 10. Continued insertion of the mating contact 12 causes the mating contact 12 to move relative to the embossments 86 of the first mating contact engagement portions 84, causing a wiping action to remove any unwanted contaminants from the mating contact 12.

As insertion of the mating contact 12 continues, the mating contact 12 engages the mating contact engagement portions 74 of the first resilient contact arms 58. This causes the mating contact engagement portions 74 and the first resilient contact arm 58 to resiliently deform, creating a mechanical and electrical connection between the mating contact engagement portions 74 and the mating contact 12. As the first resilient contact arm 58 is deformed, the embossments 76 of the contact engagement portions 72 of the first resilient contact arms 58 are deflected toward the outer surface 34 of the receiving recess 30 causing the embossments 76 of the contact engagement portions 72 to engage the outer surface 34 and exert a force on the outer surfaces 34, thereby placing the contact engagement portions 72 in mechanical and electrical engagement with the wall of the passage 14 of contact 10, forming an electrical pathway between the mating contact 12 and the contact 10. Continued insertion of the mating contact 12 causes the mating contact 12 to move relative to the embossments 86 of the mating contact engagement portions 74, causing a wiping action to remove any unwanted contaminants from the mating contact 12.

As insertion of the mating contact 12 continues, the mating contact 12 engages the embossments 86 of the second mating contact engagement portions 84 of the second resilient contact arms 60. This causes the second mating contact engagement portions 84 and the second resilient contact arms 60 to resiliently deform, creating a mechanical and electrical connection between the second mating contact engagement portions 84 and the mating contact 12. As the second resilient contact arms 60 are further deformed, the contact engagement portions 82 of the second resilient contact arms 60 are further deflected toward the outer surface 34 of the receiving recess 30 causing the contact engagement portions 82 to engage the outer surface 34 and exert a force on the outer surfaces 34, thereby placing the contact engagement portions 82 mechanical and electrical engagement with the wall of the passage 14 of contact 10, forming a secure electrical pathway between the mating contact 12 and the contact 10. Continued insertion of the mating contact 12 causes the mating contact 12 to move relative to the embossments 86 of the second mating contact engagement portions 84, causing a wiping action to remove any unwanted contaminants from the mating contact 12.

With the mating contact 12 fully inserted, the mating contact engagement portions 74 of the first resilient contact arms 58, the embossments 86 of the mating contact engagement portions 84 of the second resilient contact arms 68 and the mating contact engagement portions 94 of the third resilient contact arms 62 exert force on the mating contact 12, thereby placing the mating contact engagement portions 74, 84, 94 in mechanical and electrical engagement with the mating contact 12. The combination of numerous contact sections and the resilient forces exerted thereon, result in a stable electrical connection which can safely and effectively transmit high current there across.

The use of multiple contact sections 72, 74, 82, 84, 94 on multiple contact arms 58, 60, 62 allows the contact elements 50 to carry high amperage required by the electrical power contacts without increasing the length or diameter of the passage 14. Significantly more contact surfaces are placed in a given length (i.e., higher density of contact surfaces) thereby allowing an increased performance in power transfer across the contact elements 50. The contact sections provide for passage of high amperage current with millivolt drop (for example, but not limited to, 5-25 MVD) and lower temperature rise at high current (for example, but not limited to, 10-75 degrees Celsius with current limits to 1000 amp), thereby increasing the performance of the contact elements 50 by greater than 50%, greater than 60%, greater than 70%, between about 50% and about 70%, between about 50% and about 60%, or any suitable combination, sub-combination, range, or sub-range therein, over known contacts.

In the illustrative embodiment, the contact elements 50 shown are made from material having a thickness of about 0.004 inches to about 0.012 inches and an appropriate cross-sectional area to accommodate from about 25 amps to about 1200 amps, without failure or excessive heat buildup in the holder. However, other thicknesses and ratings of power transfer may be used without departing from the scope of the invention. The use of multiple contact elements in the same contact allows for greater power transfer without failure or excessive heat buildup in the holder.

The configuration of the contact 10 and the contact elements 50 allow for the contact to be mated with the mating contact 12 from any direction. In various circumstances, it is difficult to manipulate and twist the wire connected to the contact element 50. Often because of lack of space or the inflexibility of the wire, it is important that the contact 10 be able to be terminated to the post regardless of the orientation of the wire relative to the post. As the contact element 50 is operable no matter the orientation relative to the post, the present invention allows the termination of the wire to the post without damage to the wire or the post.

While the contact element can be used in many different housings for many different applications, the configuration allows for use with high amperage electrical connections which may require up to 1200 amps or more per contact. The contact elements, are also scalable, allowing the contacts to be sized for the desired application, such as, for example, the contact elements can be configured to operate with 4 AWG wire as well as 70 AMP contacts.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A contact element for providing high current capabilities between an electrical contact and a mating contact, the contact element comprising:

multiple first resilient contact arms extending from a first contact strip to a second contact strip, the first resilient contact arms having first contact sections and second contact sections, the first contact sections of the first resilient contact arms electrically engage the mating contact when the mating contact is fully inserted into the electrical contact, the second contact sections of the first resilient contact arms electrically engage a portion of the electrical contact when the mating contact is fully inserted into the electrical contact;

multiple second resilient contact arms extending from the second contact strip and formed to extend toward the first contact strip, the second resilient contact arms being offset from the first resilient contact arms, free ends of the second resilient contact arms positioned proximate the first contact strip, the second contact arms having first contact sections and second resilient contact sections, the first contact sections of the second resilient contact arms electrically engage the mating contact when the mating contact is fully inserted into the electrical contact, the second contact sections of the second resilient contact arms electrically engage a portion of the electrical contact when the mating contact is fully inserted into the electrical contact;

wherein the first contact sections of the first resilient contact arms, the second contact sections of the first resilient contact arms, the first contact sections of the second resilient contact arms, and the second contact sections of the second resilient contact arms provide contact sections which allow for the passage of a high amperage current with low resistance and low temperature.

2. The contact element as recited in claim 1, wherein the second resilient contact arms are wider than the first resilient contact arms.

3. The contact element as recited in claim 1, wherein each of the first resilient contact arms have multiple first contact sections and multiple second contact sections.

4. The contact element as recited in claim 1, wherein each of the second resilient contact arms have multiple first contact sections and multiple second contact sections.

5. The contact element as recited in claim 1, wherein multiple third resilient contact arms extend from the second contact strip, the third contact arms having first contact sections, the first contact sections of the third resilient contact arms electrically engage the mating contact when the mating contact is fully inserted into the electrical contact.

6. The contact element as recited in claim 5, wherein the third resilient contact arms are in line with the first resilient contact arms and offset from the second resilient contact arms, the third resilient contact arms are formed wherein free ends of the third resilient contact arms are positioned proximate the second contact strip.

7. The contact element as recited in claim 1, wherein the second contact sections of the first resilient contact arms have embossments provided thereon.

8. The contact element as recited in claim 1, wherein the first contact sections of the second resilient contact arms have embossments provided thereon.

9. The contact element as recited in claim 1, wherein the contact element has a generally cylindrical shape, with a gap provided therein, the gap allowing the contact element to be resiliently deformed.

10. A contact element for providing high current capabilities between an electrical contact and a mating contact, the contact element comprising:

multiple first resilient contact arms extending from a first contact strip to a second contact strip, the first resilient contact arms having first contact sections and second contact sections, the first contact sections of the first resilient contact arms electrically engage the mating contact when the mating contact is fully inserted into the electrical contact, the second contact sections of the first resilient contact arms electrically engage a portion of the electrical contact when the mating contact is fully inserted into the electrical contact;

multiple second resilient contact arms extending from the second contact strip and formed to extend toward the first contact strip, the second resilient contact arms being offset from the first resilient contact arms, free ends of the second resilient contact arms positioned proximate the first contact strip, the second contact arms having first contact sections and second resilient contact sections, the first contact sections of the second resilient contact arms electrically engage the mating contact when the mating contact is fully inserted into the electrical contact, the second contact sections of the second resilient contact arms electrically engage a portion of the electrical contact when the mating contact is fully inserted into the electrical contact;

multiple third resilient contact arms extending from the second contact strip, the third resilient contact arms positioned in line with the first resilient contact arms and offset from the second resilient contact arms, the third resilient contact arms being formed wherein free ends of the third resilient contact arms are positioned proximate the second contact strip, the third contact arms having first contact sections, the first contact sections of the third resilient contact arms electrically engage the mating contact when the mating contact is fully inserted into the electrical contact.

11. The contact element as recited in claim 10, wherein each of the first resilient contact arms have multiple first contact sections and multiple second contact sections.

12. The contact element as recited in claim 11, wherein each of the second resilient contact arms have multiple first contact sections and multiple second contact sections.

13. The contact element as recited in claim 12, wherein the second contact sections of the first resilient contact arms have embossments provided thereon.

14. The contact element as recited in claim 12, wherein the first contact sections of the second resilient contact arms have embossments provided thereon.

15. The contact element as recited in claim 12, wherein the second resilient contact arms are wider than the first resilient contact arms and the third resilient contact arms.

16. The contact element as recited in claim 10, wherein the contact element has a generally cylindrical shape, with a gap provided therein, the gap allowing the contact element to be resiliently deformed.

17. An electrical contact for mating with a mating contact, the electrical contact comprising:

a passage for receiving a mating contact, the passage having a recess, the recess having a contact surface;

a contact element positioned in the recess, the contact element comprising:

multiple first resilient contact arms extending from a first contact strip to a second contact strip, the first resilient contact arms having first contact sections and second contact sections, the first contact sections of the first resilient contact arms electrically engage the mating contact when the mating contact is fully inserted into the electrical contact, the second contact sections of the first resilient contact arms electrically engage the contact surface when the mating contact is fully inserted into the electrical contact;

multiple second resilient contact arms extending from the second contact strip and formed to extend toward the first contact strip, the second resilient contact arms being offset from the first resilient contact arms, free ends of the second resilient contact arms positioned proximate the first contact strip, the second contact arms having first contact sections and second resilient contact sections, the first contact sections of the second resilient contact arms electrically engage the mating contact when the mating contact is fully inserted into the electrical contact, the second contact sections of the second resilient contact arms electrically engage the contact surface when the mating contact is fully inserted into the electrical contact;

the recess having retaining shoulders to retain the contact element in the recess.

18. The electrical contact as recited in claim 17, wherein multiple third resilient contact arms extend from the second contact strip, the third contact arms having first contact sections, the first contact sections of the third resilient contact arms electrically engage the mating contact when the mating contact is fully inserted into the electrical contact.

19. The electrical contact as recited in claim 18, wherein the third resilient contact arms are in line with the first resilient contact arms and offset from the second resilient contact arms, the third resilient contact arms are formed wherein free ends of the third resilient contact arms are positioned proximate the second contact strip.

20. The electrical contact as recited in claim 19, wherein the contact element has a generally cylindrical shape, with a gap provided therein, the gap allowing the contact element to be resiliently deformed.

* * * * *